US006616334B2

(12) United States Patent
Faaborg et al.

(10) Patent No.: US 6,616,334 B2
(45) Date of Patent: Sep. 9, 2003

(54) DIE CUT RESEALABLE FLAP

(75) Inventors: Joel Faaborg, Vandalia, OH (US); Joel Slank, Piqua, OH (US); Joseph M. Everard, Easton, CT (US)

(73) Assignee: Playtex Products, Inc., Westport, CT (US)

( * ) Notice: Subject to any disclaimer, the term of this patent is extended or adjusted under 35 U.S.C. 154(b) by 0 days.

(21) Appl. No.: 09/997,727

(22) Filed: Nov. 30, 2001

(65) Prior Publication Data

US 2003/0103696 A1 Jun. 5, 2003

(51) Int. Cl.[7] ..... B65D 33/00
(52) U.S. Cl. ..... 383/211; 383/66; 383/203
(58) Field of Search ..... 383/66, 211, 203, 383/903; 206/494, 210, 812

(56) References Cited

U.S. PATENT DOCUMENTS

| | | | |
|---|---|---|---|
| 858,418 | A | 7/1907 | Savory |
| 1,794,380 | A | 3/1931 | Horwitt |
| 2,087,934 | A | 7/1937 | Anderson |
| 2,152,323 | A | 3/1939 | Moore |
| 2,267,320 | A | 12/1941 | Berch |
| 2,406,678 | A | 8/1946 | Gerahty |
| 2,574,345 | A | 11/1951 | Montgomery |
| 2,640,587 | A | 6/1953 | Smith |
| 2,678,768 | A | 5/1954 | Vergobbi |
| 3,089,298 | A | 5/1963 | Neuendorf et al. |
| 3,126,796 | A | 3/1964 | Vergobbi |
| 3,331,498 | A | 7/1967 | Davies |
| 3,743,172 | A | 7/1973 | Ackley et al. |
| 3,819,043 | A | 6/1974 | Harrison |
| 4,552,269 | A | 11/1985 | Chang |
| 4,610,357 | A | 9/1986 | Nakamura |
| 4,616,470 | A | 10/1986 | Nakamura |
| 4,678,099 | A | 7/1987 | Matsui |
| 4,679,693 | A | 7/1987 | Forman |
| 4,683,001 | A | 7/1987 | Floyd et al. |
| 4,714,454 | A | 12/1987 | Herrington |
| 4,723,301 | A | 2/1988 | Chang |
| 4,735,317 | A | 4/1988 | Sussman et al. |
| 4,735,739 | A | 4/1988 | Floyd et al. |
| 4,741,944 | A | 5/1988 | Jackson et al. |
| 4,762,124 | A | 8/1988 | Kerch et al. |
| 4,764,030 | A | 8/1988 | Humphrey |
| 4,775,582 | A | 10/1988 | Abba et al. |
| 4,785,970 | A | 11/1988 | Engelmayer |
| 4,833,003 | A | 5/1989 | Win et al. |
| 4,840,270 | A | 6/1989 | Caputo et al. |
| 4,848,575 | A | 7/1989 | Nakamura et al. |
| 4,853,281 | A | 8/1989 | Win et al. |

(List continued on next page.)

FOREIGN PATENT DOCUMENTS

| | | |
|---|---|---|
| EP | 1200787 | 9/1967 |
| EP | 0503314 A1 | 2/1992 |
| JP | 406048475 | 2/1994 |
| WO | WO 90/09933 | 9/1990 |

OTHER PUBLICATIONS

US 5,699,911, 12/1997, Joseph et al. (withdrawn)

*Primary Examiner*—Jes F. Pascua
(74) *Attorney, Agent, or Firm*—Ohlandt, Greeley, Ruggiero & Perle, LLP

(57) ABSTRACT

There is provided a resealable flap or label adapted to be placed in sealing engagement with an orifice of a flexible container. The resealable flap comprises a body having an interior portion and a pair of indented side edges. The flap has at least one hook cut extending from one of the pair of side edges to the interior portion. The body has an adhesive portion that removable connects the body over the orifice. The resealable flap or label has perforations for the at least one hook cut, which allows application of the flap by a blow on type applicator.

23 Claims, 1 Drawing Sheet

U.S. PATENT DOCUMENTS 5,050,742 A * 9/1991 Muckenfuhs ..... 206/494
5,184,896 A * 2/1993 Hammond et al. ..... 383/33
5,344,007 A 9/1994 Nakamura et al.
5,524,759 A 6/1996 Herzberg et al.
5,531,325 A 7/1996 Deflander et al.
5,582,294 A 12/1996 Yamada
5,595,786 A 1/1997 McBride, Jr. et al.
5,647,506 A 7/1997 Julius
5,664,677 A 9/1997 O'Connor
5,688,394 A 11/1997 McBride, Jr. et al.
5,725,311 A 3/1998 Ponsi et al.
D394,605 S 5/1998 Skiba et al.
5,791,465 A 8/1998 Niki et al.
5,810,200 A 9/1998 Trokhan
5,906,278 A 5/1999 Ponsi et al.
5,938,013 A 8/1999 Palumbo et al.
5,941,639 A * 8/1999 Sorenson et al. ..... 206/554
6,026,953 A 2/2000 Nakamura et al.
6,029,809 A 2/2000 Skiba et al.
6,126,009 A 10/2000 Shiffler et al.
6,158,614 A 12/2000 Haines et al.

* cited by examiner

DIE CUT RESEALABLE FLAP

BACKGROUND OF THE INVENTION

1. Field of the Invention

The present invention is directed to a resealable flap or label for a package. More particularly, the present invention is directed to a resealable flap or label with at least one hook die cut for use to seal temporarily an orifice of a flexible package. Further, the present invention is directed to a resealable flap or label with at least one angled hook die cut with perforations for use to seal temporarily the orifice in the flexible package.

2. Description of the Prior Art

Resealable flaps or labels for flexible pouches perform in a variety of ways. Some flaps can be completely removed from the package. Such completely removable flaps can be lost during removal. In addition, such flaps can become difficult for the consumer to realign onto the flexible package for proper replacement.

Another type of flap is not completely removable, but uses two different types of adhesives. The first adhesive is for the peel and reseal aspect. The second is a permanent adhesive. This permanent adhesive acts as a stop mechanism, which prevents the complete removal of the flap from the package. The problem with using two adhesives is that the application process is expensive and time consuming.

An alternative type of flap that is also not completely removable, uses a special die cut shape to allow the flap to perform as a "permanent flap". This type of flap only requires the peel and resealable adhesive. When the resealable flap is pulled, the piece of film is still attached to the flexible pouch because the die cut acts as a stop mechanism. This prevents the complete removal of the resealable flap from its flexible package. The film can easily tear and the flexible pouch could be damaged.

There are specialty die cut flaps that exhibit a stop feature. Many of these flaps tear during the peel away process from the flexible pouch. Also, distortion becomes present near the die cut designed stop. Further, this known type of die cut flaps cannot be applied by blow on type flap applicator, which is an applicator that attaches the flap to the package by blowing the flap onto the package.

The present die cut resealable flap has a portion that remains permanently connected to the body of the label. The present die cut resealable flap does not use permanent adhesive, yet may be applied by a blow on applicator.

SUMMARY OF THE INVENTION

It is an object of the present invention to provide a resealable flap or label.

It is another object of the present invention to provide a resealable flap that does not require the use of a permanent adhesive.

It is yet another object of the present invention to provide a resealable flap having at least one hook die cut.

It is still another object of the present invention to provide a resealable flap having at least one angled hook die cut.

It is still yet another object of the present invention to provide a resealable flap having perforations for the hook die cuts.

It is a further object of the present invention to provide such a resealable flap with perforations that can be applied by a blow on type flap applicator.

It is still a further object of the present invention to provide a resealable flap that is an inexpensive way to provide frequent and easy access into a sealed container.

These and other objects and advantages of the present invention are achieved by a resealable flap or label adapted to be placed in sealing engagement with an orifice of a flexible container. The resealable flap comprises a body having an interior portion and a pair of indented side edges. The flap has at least one hook cut extending from one of the pair of side edges to the interior portion. The body has an adhesive portion that removable connects the body over the orifice. The resealable flap or label has perforations for the at least one hook cut, which allows application of the flap by a blow on type applicator.

DETAILED DESCRIPTION OF THE INVENTION

Figure 1:
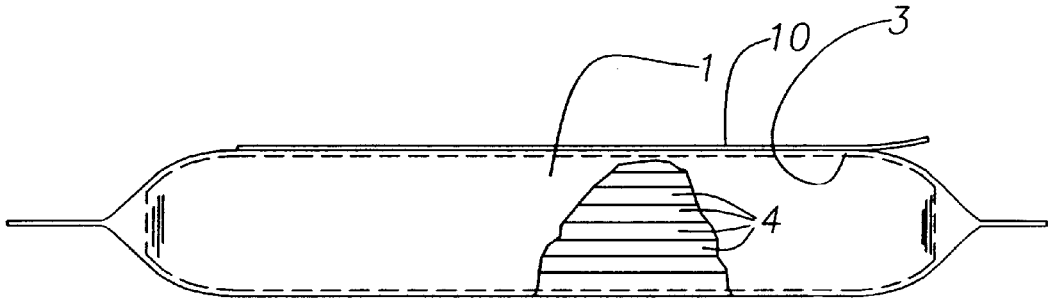
Fig. 1 (Prior Art)
FIG. 1 is a side view, partially in section, of a prior art flexible package.

Referring to the drawings and in particular FIG. 1, there is provided a flexible container generally represented by reference number 1. The container 1 has a plurality of wipes 4 therein. The container 1 has an orifice or opening 3 and a flap or label 10. The flap 10 is adapted to be removably positioned on orifice or opening 3.

Figure 2:
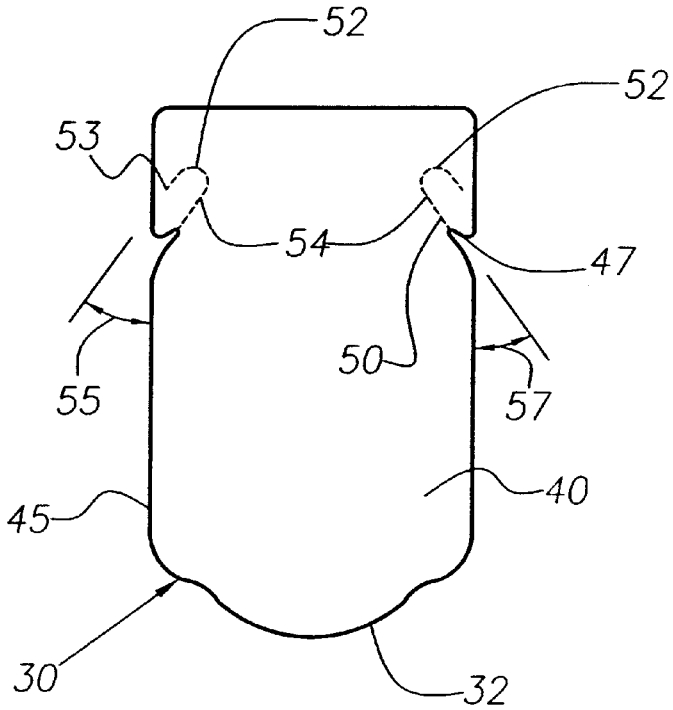
FIG. 2 is a front view of an embodiment of the resealable flap of the present invention.
Figure 1:
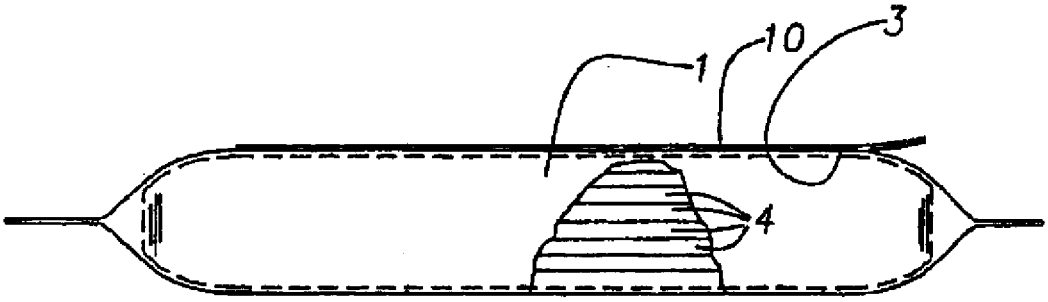
Fig. 1 (Prior Art)
Figure 2:
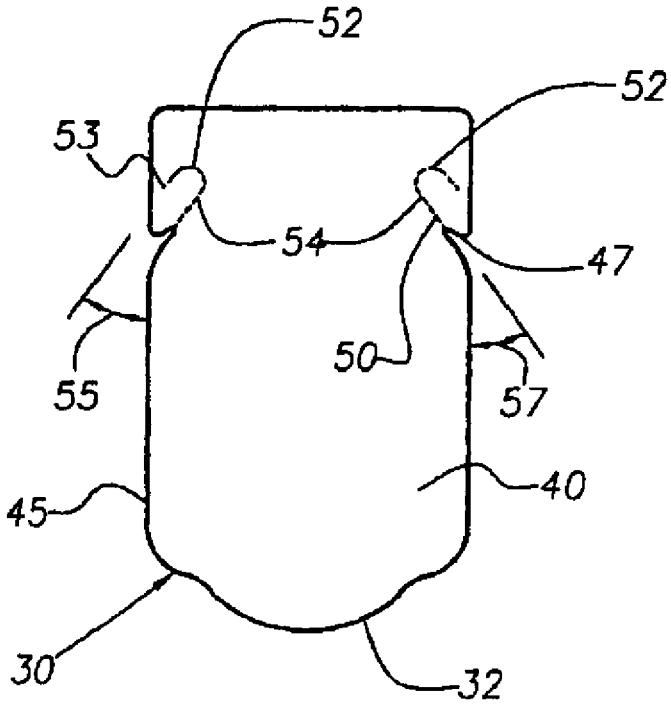

Referring to FIG. 2, the flap or label of the present invention is generally represented by reference numeral 30. The flap 30 has a body portion 40. The body portion 40 has a pair of longitudinal edges 45 that run parallel to the longitudinal axis of the flap. Each edge 45 has a cutout or notch 47. Each notch 47 leads to a hook-shaped die cut 50.

Each hook die cut 50 has, at its free end 53, a curved portion 52. The curved portion 52 preferably forms a perfect U-shape or hook. The free end 53 of hook 52 forms a first angle 55 toward edge 45 of flap 30. The hook 52 prevents flap 30 from tearing during removal from the orifice of the flexible package as the free ends 53 are pointed in a direction opposite the removal direction. The hook 52 is formed by a die cut, and free end 53 is angled to prevent complete removal of resealable flap 30 from the flexible package. The first angle 55 of free end 53 is between about 1 degree to about 90 degrees, preferably the first angle is between about 15 degrees to about 45 degrees, and most preferably at about 35 degrees.

The die cut that forms each hook 52 makes one or more perforations 54. Each perforation 54 is a gap or non-cut portion along the hook die cut line. Each perforation 54 has a unique role in the application of flap 30 onto the package.

The resealable flap 30 is applied onto the package using a blow on applicator. The flow on applicator process used may be any process known in the art. By way of example, the blow on applicator process is briefly described herein. The resealable flap or label 30 is wound on a roll with a specified unwind position based on the application. The applicator advances flap 30 under a vacuum. The vacuum holds flap 30 in place until it is ready to be applied. When flap 30 is in position to be applied to the packaging film, small air lines provide a burst of air that overcomes the vacuum and forces flap 30 onto the surface of the packaging film.

The perforations 54 in the hook die cuts are an important aspect for consistent and flawless application of flap 30 onto the package. The perforations 54 are used to keep the wings of the hinge connected to body portion 40 of flap 30. This connection eliminates any abnormal flap appearance when using a blow on type of flap applicator. As flap 30 is blown onto the package, the perforations surprisingly provide steadiness so that the flap is applied evenly onto the package thereby reducing bubbles or overlap. The perforations 54 further provide support to prevent the complete removal of resealable flap 30. Further, perforations 54 function as an added stop mechanism because they prevent easy tearing through of the hook die cut.

The cutout or notch 47 on each edge 45 of flap 30 is an additional feature. The cutouts 47 form a second angle 57 into the film and are located at the junction where the hook die cut meets the edge of the film. These cutouts 47 direct flap 30 towards the angled hook 52 during the peeling of the flap, thereby eventually stopping the resealable action. Since curved portion 52 preferably forms a perfect U-shape, each cutout 47 is pointed in the removal direction.

The resealable flap 30 has a free end 32. The free end 32 has a resealable adhesive that permits flap 30 to be resealed to the flexible package over the orifice. Thus, the adhesive permits peeling away from the orifice to provide a user with access to the cleansing sheets, and resealing of flap 30 onto the flexible package.

While particular embodiments of the present invention have been illustrated and described herein, the present invention should not be limited to such illustrations and description. It should be apparent that changes and modifications may be incorporated and embodied as part of the present invention within the scope of the following claims.

What is claimed is:

1. A resealable flap for removably closing an orifice of a flexible package, the flap comprising:

a body portion having an interior and a pair of side edges, said interior having a resealable adhesive thereon; and a pair of hook cuts being positioned in said body portion, each one of said pair of hook cuts extending from a different one of said pair of side edges, wherein said resealable adhesive is adapted to removably seal said body portion over the orifice of the flexible package, and wherein each of said pair of hook cuts has at least one perforation.

2. The resealable flap of claim 1, wherein each of said pair of hook cuts has a free end that is at a first angle with respect to said different one of said pair of side edges.

3. The resealable flap of claim 1, wherein said at least one perforation provides steadiness to said hook cuts during application of the releasable flap to the flexible package and/or to function as an added stop mechanism preventing easy tearing through of the releasable flap.

4. The resealable flap of claim 1, wherein said adhesive is non-permanent.

5. The resealable flap of claim 1, wherein the flap is made of a polymeric material.

6. The resealable flap of claim 2, wherein said first angle is between about 1 degrees to about 90 degrees.

7. The resealable flap of claim 6, wherein said first angle is between about 15 degrees to about 45 degrees.

8. The resealable flap of claim 6, wherein said first angle is about 35 degrees.

9. The resealable flap of claim 1, further comprising a pair of notches.

10. The resealable flap of claim 9, wherein each of said pair of notches are in said body portion.

11. A system for dispensing cleansing wipes comprising:

a container having an orifice; and a plurality of cleansing wipes in said container;

a resealable flap having a first end secured to said container and a second, free end, said resealable flap having:

a body portion having an interior and a pair of side edges, said interior having a resealable adhesive thereon; and a pair of hook cuts, each one of said pair of hook cuts extending from a different one of said pair of side edges and positioned in said body portion, wherein said resealable adhesive is adapted to removably seal said body portion over the orifice of the container, and wherein each of said pair of hook cuts has at least one perforation.

12. The system of claim 11, wherein each of said pair of hook cuts has a free end that is at a first angle with respect to said one of said pair of side edges.

13. The system of claim 11, wherein said at least one perforation provides steadiness to said hook cuts during application of the releasable flap to the flexible container and/or to function as an added stop mechanism preventing easy tearing through of the releasable flap.

14. The system of claim 11, wherein said adhesive is non-permanent.

15. The system of claim 11, wherein said resealable flap is made of a polymeric material.

16. The system of claim 12, wherein said first angle is between about 1 degrees to about 90 degrees.

17. The system of claim 16, wherein said first angle is between about 15 degrees to about 45 degrees.

18. The system of claim 16, wherein said first angle is about 35 degrees.

19. The system of claim 11, further comprising a pair of notches.

20. The system of claim 19, wherein each of said pair of notches are in said body portion.

21. A resealable flap for closing an orifice of a flexible package, the resealable flap comprising:

a body portion having an interior, a first side edge, and a second side edge, said interior having a resealable adhesive thereon, said resealable adhesive being adapted to removably seal said body portion over the orifice of the flexible package;

each of said first and second side edges having a notch formed therein, each of said notches being angled with respect to a different one of said side first and second side edges in an opening direction; and each of said first and second side edges having a die cut formed through said body portion, each of said notches being located at a junction where said die cut meets said respective one of said first and second side edges, said die cuts having a curved portion that defines a free end that is angled with respect to said respective one of said first and second side edges in a direction opposite said opening direction.

22. The resealable flap of claim 21, further comprising at least one perforation defined in each of said die cuts.

23. The resealable flap of claim 22, wherein said at least one perforation defined in each of said die cuts provides steadiness to said hook cuts during application of the releasable flap to the flexible container and/or to function as an added stop mechanism preventing easy tearing through of the releasable flap.

* * * * *

UNITED STATES PATENT AND TRADEMARK OFFICE

CERTIFICATE OF CORRECTION

PATENT NO. : 6,616,334 B2
APPLICATION NO. : 09/997727
DATED : September 9, 2003
INVENTOR(S) : Faaborg et al.

It is certified that error appears in the above-identified patent and that said Letters Patent is hereby corrected as shown below:

Please delete the entire patent and substitute the new Title Page 1 and 2, Drawing Page 1 and Columns 1 Line 1 through Column 6 Line 40 as attached Signed and Sealed this Nineteenth Day of May, 2009

John Doll

JOHN DOLL
*Acting Director of the United States Patent and Trademark Office*

(12) United States Patent
Faaborg et al.

(10) Patent No.: US 6,616,334 B2
(45) Date of Patent: Sep. 9, 2003

(54) DIE CUT RESEALABLE FLAP

(75) Inventors: Joel Faaborg, Vandalia, OH (US); Joel Slank, Piqua, OH (US); Joseph M. Everard, Easton, CT (US)

(73) Assignee: Playtex Products, Inc., Westport, CT (US)

( * ) Notice: Subject to any disclaimer, the term of this patent is extended or adjusted under 35 U.S.C. 154(b) by 0 days.

(21) Appl. No.: 09/997,727

(22) Filed: Nov. 30, 2001

(65) Prior Publication Data

US 2003/0103696 A1 Jun. 5, 2003

(51) Int. Cl.[7] ..... B65D 33/00
(52) U.S. Cl. ..... 383/211; 383/66; 383/203
(58) Field of Search ..... 383/66, 211, 203, 383/903; 206/494, 210, 812

(56) References Cited

U.S. PATENT DOCUMENTS

| | | | |
|---|---|---|---|
| 858,418 | A | 7/1907 | Savory |
| 1,794,380 | A | 3/1931 | Horwitt |
| 2,087,934 | A | 7/1937 | Anderson |
| 2,152,323 | A | 3/1939 | Moore |
| 2,267,320 | A | 12/1941 | Berch |
| 2,406,678 | A | 8/1946 | Gerahty |
| 2,574,345 | A | 11/1951 | Montgomery |
| 2,640,587 | A | 6/1953 | Smith |
| 2,678,768 | A | 5/1954 | Vergobbi |
| 3,089,298 | A | 5/1963 | Neuendorf et al. |
| 3,126,796 | A | 3/1964 | Vergobbi |
| 3,331,498 | A | 7/1967 | Davies |
| 3,743,172 | A | 7/1973 | Ackley et al. |
| 3,819,043 | A | 6/1974 | Harrison |
| 4,552,269 | A | 11/1985 | Chang |
| 4,610,357 | A | 9/1986 | Nakamura |
| 4,616,470 | A | 10/1986 | Nakamura |
| 4,678,099 | A | 7/1987 | Matsui |
| 4,679,693 | A | 7/1987 | Forman |
| 4,683,001 | A | 7/1987 | Floyd et al. |
| 4,714,454 | A | 12/1987 | Herrington |
| 4,723,301 | A | 2/1988 | Chang |
| 4,735,317 | A | 4/1988 | Sussman et al. |
| 4,735,739 | A | 4/1988 | Floyd et al. |
| 4,741,944 | A | 5/1988 | Jackson et al. |
| 4,762,124 | A | 8/1988 | Kerch et al. |
| 4,764,030 | A | 8/1988 | Humphrey |
| 4,775,582 | A | 10/1988 | Abba et al. |
| 4,785,970 | A | 11/1988 | Engelmayer |
| 4,833,003 | A | 5/1989 | Win et al. |
| 4,840,270 | A | 6/1989 | Caputo et al. |
| 4,848,575 | A | 7/1989 | Nakamura et al. |
| 4,853,281 | A | 8/1989 | Win et al. |

(List continued on next page.)

FOREIGN PATENT DOCUMENTS

| | | |
|---|---|---|
| EP | 1200787 | 9/1967 |
| EP | 0503314 A1 | 2/1992 |
| JP | 406048475 | 2/1994 |
| WO | WO 90/09933 | 9/1990 |

OTHER PUBLICATIONS

US 5,699,911, 12/1997, Joseph et al. (withdrawn)

*Primary Examiner*—Jes F. Pascua
(74) *Attorney, Agent, or Firm*—Ohlandt, Greeley, Ruggiero & Perle, LLP

(57) ABSTRACT

There is provided a resealable flap or label adapted to be placed in sealing engagement with an orifice of a flexible container. The resealable flap comprises a body having an interior portion and a pair of indented side edges. The flap has at least one hook cut extending from one of the pair of side edges to the interior portion. The body has an adhesive portion that removable connects the body over the orifice. The resealable flap or label has perforations for the at least one hook cut, which allows application of the flap by a blow on type applicator.

23 Claims, 1 Drawing Sheet

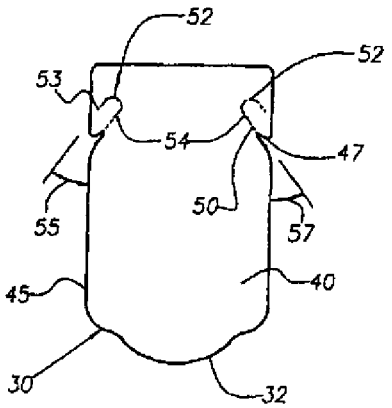

U.S. PATENT DOCUMENTS 5,050,742 A * 9/1991 Muckenfuhs ..... 206/494
5,184,896 A * 2/1993 Hammond et al. ..... 383/33
5,344,007 A 9/1994 Nakamura et al.
5,524,759 A 6/1996 Herzberg et al.
5,531,325 A 7/1996 Deflander et al.
5,582,294 A 12/1996 Yamada
5,595,786 A 1/1997 McBride, Jr. et al.
5,647,506 A 7/1997 Julius
5,664,677 A 9/1997 O'Connor
5,688,394 A 11/1997 McBride, Jr. et al.
5,725,311 A 3/1998 Ponsi et al.
D394,605 S 5/1998 Skiba et al.
5,791,465 A 8/1998 Niki et al.
5,810,200 A 9/1998 Trokhan
5,906,278 A 5/1999 Ponsi et al.
5,938,013 A 8/1999 Palumbo et al.
5,941,639 A * 8/1999 Sorenson et al. ..... 206/554
6,026,953 A 2/2000 Nakamura et al.
6,029,809 A 2/2000 Skiba et al.
6,126,009 A 10/2000 Shiffler et al.
6,158,614 A 12/2000 Haines et al.

* cited by examiner

DIE CUT RESEALABLE FLAP

BACKGROUND OF THE INVENTION

1. Field of the Invention

The present invention is directed to a resealable flap or label for a package. More particularly, the present invention is directed to a resealable flap or label with at least one hook die cut for use to seal temporarily an orifice of a flexible package. Further, the present invention is directed to a resealable flap or label with at least one angled hook die cut with perforations for use to seal temporarily the orifice in the flexible package.

2. Description of the Prior Art

Resealable flaps or labels for flexible pouches perform in a variety of ways. Some flaps can be completely removed from the package. Such completely removable flaps can be lost during removal. In addition, such flaps can become difficult for the consumer to realign onto the flexible package for proper replacement.

Another type of flap is not completely removable, but uses two different types of adhesives. The first adhesive is for the peel and reseal aspect. The second is a permanent adhesive. This permanent adhesive acts as a stop mechanism, which prevents the complete removal of the flap from the package. The problem with using two adhesives is that the application process is expensive and time consuming.

An alternative type of flap that is also not completely removable, uses a special die cut shape to allow the flap to perform as a "permanent flap". This type of flap only requires the peel and resealable adhesive. When the resealable flap is pulled, the piece of film is still attached to the flexible pouch because the die cut acts as a stop mechanism. This prevents the complete removal of the resealable flap from its flexible package. The film can easily tear and the flexible pouch could be damaged.

There are specialty die cut flaps that exhibit a stop feature. Many of these flaps tear during the peel away process from the flexible pouch. Also, distortion becomes present near the die cut designed stop. Further, this known type of die cut flaps cannot be applied by blow on type flap applicator, which is an applicator that attaches the flap to the package by blowing the flap onto the package.

The present die cut resealable flap has a portion that remains permanently connected to the body of the label. The present die cut resealable flap does not use permanent adhesive, yet may be applied by a blow on applicator.

SUMMARY OF THE INVENTION

It is an object of the present invention to provide a resealable flap or label.

It is another object of the present invention to provide a resealable flap that does not require the use of a permanent adhesive.

It is yet another object of the present invention to provide a resealable flap having at least one hook die cut.

It is still another object of the present invention to provide a resealable flap having at least one angled hook die cut.

It is still yet another object of the present invention to provide a resealable flap having perforations for the hook die cuts.

It is a further object of the present invention to provide such a resealable flap with perforations that can be applied by a blow on type flap applicator.

It is still a further object of the present invention to provide a resealable flap that is an inexpensive way to provide frequent and easy access into a sealed container.

These and other objects and advantages of the present invention are achieved by a resealable flap or label adapted to be placed in sealing engagement with an orifice of a flexible container. The resealable flap comprises a body having an interior portion and a pair of indented side edges. The flap has at least one hook cut extending from one of the pair of side edges to the interior portion. The body has an adhesive portion that removable connects the body over the orifice. The resealable flap or label has perforations for the at least one hook cut, which allows application of the flap by a blow on type applicator.

BRIEF DESCRIPTION OF THE DRAWINGS

FIG. 1 is a side view, partially in section, of a prior art flexible package; and FIG. 2 is a front view of an embodiment of the resealable flap of the present invention.

DETAILED DESCRIPTION OF THE INVENTION

Referring to the drawings and in particular FIG. 1, there is provided a flexible container generally represented by reference number 1. The container 1 has a plurality of wipes 4 therein. The container 1 has an orifice or opening 3 and a flap or label 10. The flap 10 is adapted to be removably positioned on orifice or opening 3.

Referring to FIG. 2, the flap or label of the present invention is generally represented by reference numeral 30. The flap 30 has a body portion 40. The body portion 40 has a pair of longitudinal edges 45 that run parallel to the longitudinal axis of the flap. Each edge 45 has a cutout or notch 47. Each notch 47 leads to a hook-shaped die cut 50.

Each hook die cut 50 has, at its free end, a curved portion 52. The curved portion 52 preferably forms a perfect U-shape or hook. The free end 53 of hook 52 forms a first angle 55 toward edge 45 of flap 30. The hook 52 prevents flap 30 from tearing during removal from the orifice of the flexible package as the free ends 53 are pointed in a direction opposite the removal direction. The hook 52 is formed by a die cut, and free end 53 is angled to prevent complete removal of resealable flap 30 from the flexible package. The first angle 55 of free end 53 is between about 1 degree to about 90 degrees, preferably the first angle is between about 15 degrees to about 45 degrees, and most preferably at about 35 degrees.

The die cut that forms each hook 52 makes one or more perforations 54. Each perforation 54 is a gap or non-cut portion along the hook die cut line. Each perforation 54 has a unique role in the application of flap 30 onto the package.

The resealable flap 30 is applied onto the package using a blow on applicator. The blow on applicator process used may b e any process known in the art. By way of example, the blow on applicator process is briefly described herein. The resealable flap or label 30 is wound on a roll with a specified unwind position based on the application. The applicator advances flap 30 under a vacuum. The vacuum holds flap 30 in place until it is ready to be applied. When flap 30 is in position to be applied to the packaging film, small air lines provide a burst of air that overcomes the vacuum and forces flap 30 onto the surface of the packaging film.

The perforations 54 in the hook die cuts are an important aspect for consistent and flawless application of flap 30 onto the package. The perforations 54 are used to keep the wings of the hinge connected to body portion 40 of flap 30. This connection eliminates any abnormal flap appearance when using a blow on type of flap applicator. As flap 30 is blown onto the package, the perforations surprisingly provide steadiness so that the flap is applied evenly onto the package thereby reducing bubbles or overlap. The perforations 54 further provide support to prevent the complete removal of resealable flap 30. Further, perforations 54 function as an added stop mechanism because they prevent easy tearing through of the hook die cut.

The cutout or notch 47 on each edge 45 of flap 30 is an additional feature. The cutouts 47 form a second angle 56 into the film and are located at the junction where the hook die cut meets the edge of the film. These cutouts 47 direct flap 30 towards the angled hook 52 during the peeling of the flap, thereby eventually stopping the resealable action. Since curved portion 52 preferably forms a perfect U-shape, each cutout 47 is pointed in the removal direction.

The resealable flap 30 has a free end 32. The free end 32 has a resealable adhesive that permits flap 30 to be resealed to the flexible package over the orifice. Thus, the adhesive permits peeling away from the orifice to provide a user with access to the cleansing sheets, and resealing of flap 30 onto the flexible package.

While particular embodiments of the present invention have been illustrated and described herein, the present invention should not be limited to such illustrations and description. It should be apparent that changes and modifications may be incorporated and embodied as part of the present invention within the scope of the following claims.

What is claimed is:

1. A resealable flap for removably closing an orifice of a flexible package, the flap comprising:

a body portion having an interior and a pair of side edges, said interior having a resealable adhesive thereon; and a pair of hook cut lines being positioned in said body portion, each one of said pair of hook cut lines extending from a different one of said pair of side edges, wherein said resealable adhesive is adapted to removably seal said body portion over the orifice of the flexible package, and wherein each of said pair of hook cut lines has a plurality of perforations.

2. The resealable flap of claim 1, wherein each of said pair of hook cut lines has a free end that is at a first angle with respect to said different one of said pair of side edges.

3. The resealable flap of claim 1, wherein said a plurality of perforations provides steadiness to said hook cut lines during application of the releasable flap to the flexible package and/or to function as an added stop mechanism preventing easy tearing through of the releasable flap.

4. The resealable flap of claim 1, wherein said adhesive is non-permanent.

5. The resealable flap of claim 1, wherein the flap is made of a polymeric material.

6. A resealable flap for removably closing an orifice of a flexible package, the flap comprising:

a body portion having an interior and a pair of side edges, said interior having a resealable adhesive thereon; and a pair of hook cut lines being positioned in said body portion, each one of said pair of hook cut lines extending from a different one of said pair of side edges, wherein said resealable adhesive is adapted to removably seal said body portion over the orifice of the flexible package, and wherein each of said pair of hook cut lines has at least one perforation, wherein each of said pair of hook cut lines has a free end that is at a first angle with respect to said different one of said pair of side edges, and wherein said first angle is between about 1 degrees to about 90 degrees.

7. The resealable flap of claim 6, wherein said first angle is between about 15 degrees to about 45 degrees.

8. The resealable flap of claim 6, wherein said first angle is about 35 degrees.

9. A resealable flap for removably closing an orifice of a flexible package, the flap comprising:

a body portion having an interior and a pair of side edges, said interior having a resealable adhesive thereon;

a pair of hook cut lines being positioned in said body portion, each one of said pair of hook cut lines extending from a different one of said pair of side edges, wherein said resealable adhesive is adapted to removably seal said body portion over the orifice of the flexible package, and wherein each of said pair of hook cut lines has at least one perforation; and a pair of notches with each being disposed between a different one of said pair of side edges and a different one of said pair of hook cut lines.

10. The resealable flap of claim 9, wherein each of said pair of notches is in said body portion.

11. A system for dispensing cleansing wipes comprising:

a container having an orifice; and a plurality of cleansing wipes in said container;

a resealable flap having a first end secured to said container and a second, free end, said resealable flap having:

a body portion having an interior and a pair of side edges, said interior having a resealable adhesive thereon; and a pair of hook cut lines, each one of said pair of hook cut lines extending from a different one of said pair of side edges and positioned in said body portion, wherein said resealable adhesive is adapted to removably seal said body portion over the orifice of the container, and wherein each of said pair of hook cut lines has a plurality of perforations.

12. The system of claim 11, wherein each of said pair of hook cut lines has a free end that is at a first angle with respect to said one of said pair of side edges.

13. The system of claim 11, wherein said plurality of perforations provides steadiness to said hook cut lines during application of the releasable flap to the flexible container and/or to function as an added stop mechanism preventing easy tearing through of the releasable flap.

14. The system of claim 11, wherein said adhesive is non-permanent.

15. The system of claim 11, wherein said resealable flap is made of a polymeric material.

16. A system for dispensing cleansing wipes comprising:

a container having an orifice; and a plurality of cleansing wipes in said container;

a resealable flap having a first end secured to said container and a second, free end, said resealable flap having:

a body portion with an interior and a pair of side edges, said interior having a resealable adhesive thereon; and a pair of hook cut lines, each one of said pair of hook cut lines extending from a different one of said pair of side edges and positioned in said body portion, wherein said resealable adhesive is adapted to removably seal said body portion over the orifice of the container, and wherein each of said pair of hook cut lines has at least one perforation, wherein each of said pair of hook cut lines has a free end that is at a first angle with respect to said one of said pair of side edges, and wherein said first angle is between about 1 degrees to about 90 degrees.

17. The system of claim 16, wherein said first angle is between about 15 degrees to about 45 degrees.

18. The system of claim 16, wherein said first angle is about 35 degrees.

19. A system for dispensing cleansing wipes comprising:

a container having an orifice;

a plurality of cleansing wipes in said container;

a resealable flap having a first end secured to said container and a second, free end, said resealable flap having:

a body portion with an interior and a pair of side edges, said interior having a resealable adhesive thereon;

a pair of hook cut lines, each one of said pair of hook cut lines extending from a different one of said pair of side edges and positioned in said body portion, wherein said resealable adhesive is adapted to removably seal said body portion over the orifice of the container, and wherein each of said pair of hook cut lines has at least one perforation; and a pair of notches with each being disposed between a different one of said pair of side edges and a different one of said pair of hook cut lines.

20. The system of claim 19, wherein each of said pair of notches is in said body portion.

21. A resealable flap for closing an orifice of a flexible package, the resealable flap comprising:

a body portion having an interior, a first side edge, and a second side edge, said interior having a resealable adhesive thereon, said resealable adhesive being adapted to removably seal said body portion over the orifice of the flexible package;

each of said first and second side edges having a notch formed therein, each of said notches being angled with respect to a different one of said side first and second side edges in an opening direction; and each of said first and second side edges having a die cut line formed through said body portion, each of said notches being located at a junction where said die cut line meets said respective one of said first and second side edges, said die cut lines having a curved portion that defines a free end that is angled with respect to said respective one of said first and second side edges in a direction opposite said opening direction.

22. A resealable flap for closing an orifice of a flexible package, the resealable flap comprising:

a body portion having an interior, a first side edge, and a second side edge, said interior having a resealable adhesive thereon, said resealable adhesive being adapted to removably seal said body portion over the orifice of the flexible package;

each of said first and second side edges having a notch formed therein, each of said notches being angled with respect to a different one of said side first and second side edges in an opening direction;

each of said first and second side edges having a die cut line formed through said body portion, each of said notches being located at a junction where said die cut line meets said respective one of said first and second side edges, said die cut lines having a curved portion that defines a free end that is angled with respect to said respective one of said first and second side edges in a direction opposite said opening direction; and a plurality of perforations defined along each of said die cut lines.

23. The resealable flap of claim 22, wherein said plurality of perforations defined along each of said die cut lines provides steadiness to said die cut lines during application of the releasable flap to the flexible container and/or to function as an added stop mechanism preventing easy tearing through of the releasable flap.

* * * * *